US005482579A

United States Patent [19]

Ochi et al.

[11] Patent Number: 5,482,579

[45] Date of Patent: Jan. 9, 1996

[54] GAS GENERATOR COMPOSITIONS

[75] Inventors: Koji Ochi, Aichi; Nobukazu Asano, Handa; Kazunori Matsuda; Kiyoaki Yanase, both of Aichi, all of Japan

[73] Assignee: NOF Corporation, Tokoyo, Japan

[21] Appl. No.: 227,725

[22] Filed: Apr. 14, 1994

[30] Foreign Application Priority Data

| | | | |
|---|---|---|---|
| Apr. 15, 1993 | [JP] | Japan | 5-088897 |
| Aug. 17, 1993 | [JP] | Japan | 5-203414 |
| Aug. 20, 1993 | [JP] | Japan | 5-206623 |

[51] Int. Cl.[6] ..... C06B 29/08

[52] U.S. Cl. ..... 149/83; 149/77

[58] Field of Search ..... 149/77, 83

[56] References Cited

U.S. PATENT DOCUMENTS

| | | | |
|---|---|---|---|
| 3,214,304 | 10/1965 | Vriesen | 149/19 |
| 3,806,461 | 4/1974 | Hendrickson et al. | 252/188.3 R |
| 3,862,866 | 1/1975 | Timmerman et al. | 149/21 |

FOREIGN PATENT DOCUMENTS

| | | |
|---|---|---|
| 0055547 | 7/1982 | European Pat. Off. . |
| 2235282 | 1/1975 | France . |
| 945010 | 6/1956 | Germany . |
| 2063586 | 12/1970 | Germany . |
| 2334063B2 | 1/1974 | Germany . |
| 4412871 | 4/1994 | Germany . |

*Primary Examiner*—Donald P. Walsh
*Assistant Examiner*—Anthony R. Chi
*Attorney, Agent, or Firm*—Vidas, Arrett & Steinkraus

[57] ABSTRACT

A gas generator composition, primarily containing perchlorate and cellulose acetate is provided to generate a large amount of gas without forming any substantial amount of harmful carbon monoxide. A metal oxide is additionally incorporated in an amount of more than 5% by weight and not more than 40% by weight. For example, 50 to 87% by weight of potassium perchlorate and 8 to 26% by weight of cellulose acetate are incorporated in the composition. The gas generator composition contains 36% by weight or less of bitetrazole metal hydrate, preferably bitetrazole manganese dihydrate, since it forms no corrosive residue after burning. The composition contains a nonmetallic compound consisting at least of nitrogen and hydrogen and containing at least 11% by weight of nitrogen. As such compound, nitroguanidine, guanidine nitrate, etc. is employed. The compounds preferably contains 10 to 83% by weight of nitrogen. The compound is preferably incorporated in an amount of 10 to 45% by weight. The gas generator composition is molded into a desired form, such as pellet, rod and disc and loaded in the combustion chamber of a gas generator. The composition is ignited by firing an igniter and burned to generate a gas.

20 Claims, 1 Drawing Sheet

GAS GENERATOR COMPOSITIONS

BACKGROUND OF THE INVENTION

1. Field of the Invention

The present invention relates to a gas generator composition used in a gas generator for generating a large volume of gas in relatively short period of time. A container may be attached, for example, to the steering wheel of an automobile in order to inflate an air bag.

2. Description of the Related Art

With the growing public demand for safer automobiles, air bags are more frequently found as a standard feature in new cars sold today. These gas inflated devices are well known as passive restraint systems used to reduce the injuries caused to automobile occupants in event of a car collision. Such air bags are commonly attached to the steering wheel or front dash panel in the car's passenger compartment. A main component of these air bag systems is the gas generator composition employed in order to inflate the air bag. Conventionally known gas generator compositions primarily contain sodium azide and various types of oxidizing agents, and are typically molded into pellets or rods. This generator composition is incorporated into a metallic case such as of stainless steel and aluminum, and when burned, generates nitrogen gas which inflates the air bag.

While the present composition is particularly suitable for inflating air bags in automobiles, it can also be utilized an application where a large amount of gas is required such as an inflatable raft. Such a composition can also be utilized for inflating an air bag employed in a passenger escape chute of an airplane.

To date, the preferred gas generator primarily contains sodium azide which produces clean nitrogen gas when burned. Unfortunately, sodium azide is itself highly toxic and readily hydrolysis to form hydrogen azide. Hydrogen azide is also highly toxic and explosive as well. In addition, sodium azide and hydrogen azide are likely to form volatile and explosive substances when brought in contact with acids or heavy metals.

Accordingly, in order to easily handle compositions containing azide compounds, special care must be taken during the production, storage and utilization of the compound. Moreover, the compositions essentially containing sodium azide produce, upon combustion, large amounts of corrosive residues such as sodium and sodium compounds. These compounds must be effectively treated and converted to noncorrosive compounds before they are discarded.

In order to solve these problems, efforts have been made to produce a gas generator composition containing no sodium azide. For example, Japanese Patent Publication No. 20919/1983 discloses a composition comprising the following three components: (1) an oxidizing agent, (2) a cellulose acetate and (3) a carbon-containing combustion controller. More specifically, the composition contains (1) 78 to 92% by weight of a chlorate or perchlorate of an alkali metal or alkaline earth metal as the oxidizing agent, (2) 7.9 to 17.2% by weight of a cellulose acetate and (3) 0.1 to 0.8% by weight of a carbon-containing combustion controller.

As a carbon-containing combustion controller, for example, acetylene black or graphite is used. This composition typically generates about 0.36 lit/g of a gas consisting primarily of water, carbon dioxide and oxygen, for example, under the normal conditions.

However, the composition described in the above patent publication has a very high combustion temperature. Accordingly, when the composition is used in a gas generator container the generated gas must be cooled to prevent the air bag from burning etc. Thus, a large amount of cooling agent must be provided in the gas generator container for the above compositions. This requirement effectively prevents manufacturers from being able to reduce the size of the conventional gas generator container.

Size and weight reduction for gas generator containers can generally be achieved in a more sophisticated manner by increasing the amount of gas to be generated per unit .weight of the composition. This reduces the amount of the gas generator composition necessary per gas generator container. However, such downsizing or weight reduction has not fully been achieved yet. Another disadvantage of previous gas generator compositions is that they produce harmful carbon monoxide.

SUMMARY OF THE INVENTION

Accordingly, it is a primary objective of the present invention to provide a gas generator composition which does not contain sodium azide and does not form any substantial amounts of carbon monoxide.

It is a further object of the present invention to provide a composition which generates a large amount of gas at low combustion temperatures, and which allows the amount of the cooling agent to be effectively reduced, thereby permitting the use of smaller gas generator containers.

BRIEF DESCRIPTION OF THE DRAWINGS

The features of this invention that are believed to be novel are set forth with particularity in the appended claims.

The invention, together with objects and advantages thereof, may best be understood by reference to the following description of the presently preferred embodiments taken in conjunction with the accompanying drawing.

DETAILED DESCRIPTION OF THE PREFERRED EMBODIMENTS

Figure 1:
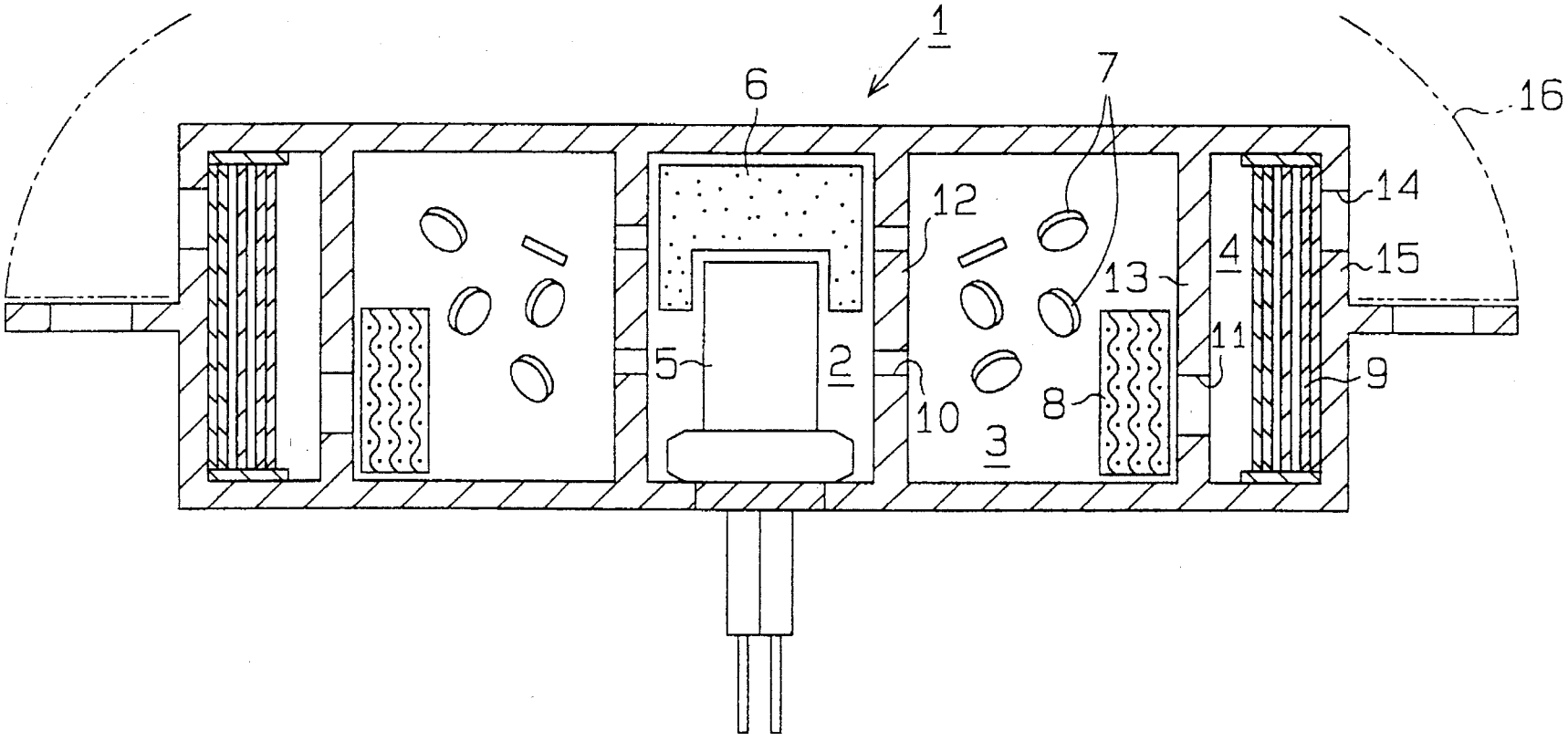
FIG. 1 illustrates an embodiment of the container for gas generator in which the gas generator composition according to the present invention is contained.

The present invention will be described below in more detail.

Cellulose acetate is a combustible material consisting of carbon, hydrogen and oxygen. After being mixed with an oxidizing agent, cellulose acetate burns to produce large amounts of carbon dioxide, water and oxygen. Cellulose acetate is also soluble in certain solvents and becomes gelatinous when dissolved in such solvents. Accordingly, when cellulose acetate is mixed with a powder such as of an oxidizing agent, the cellulose acetate interposes the gaps between the powder particles and thus acts as a binder.

In order that cellulose acetate functions as a thorough binding agent, the cellulose acetate should be provided in the composition by an amount of at least 8% by weight. If the amount of cellulose acetate is less than 8% by weight, the cellulose acetate barely covers the powder particles entirely, and only incompletely interposes the gaps between the powder particles. The upper limit of cellulose acetate possible for use in interposing the gaps between the powder particles is determined by the presence of carbon monoxide upon the combustion of the cellulose acetate.

The conditions under which carbon monoxide is deemed not to be substantially produced is when it is determined that the concentration of carbon monoxide in the gas generated is 5000 ppm or less. The maximum amount of cellulose acetate which can be used under these conditions depends on such factors as the ratios of perchlorate used as the oxidizing agent, and on the bitetrazole metal hydrate used for controlling the combustion temperature. An additional factor is whether a metal oxide employed for controlling the combustion temperature is to be incorporated. However, the upper limit of cellulose acetate is preferably 26% by weight or less. Accordingly, cellulose acetate is preferably incorporated into the composition in the range of 8 to 26% by weight.

Perchlorate, as an oxidizing agent, generates a relatively large amount of oxygen per unit weight compared to other oxidizers, and has excellent heat stability. The perchlorate can be exemplified by potassium perchlorate, ammonium perchlorate and sodium perchlorate. Potassium perchlorate among others is free from hygroscopicity and forms a potassium perchlorate residue after burning. Potassium perchlorate is highly preferred as an oxidizer to the composition since it is lacks any substantial corrosive characteristics.

The particle size of potassium perchlorate may be variable so long as it is within the range of 5 to 300 μm. However, when two or more potassium perchlorate powders having different particle sizes are to be employed, they should be incorporated so that the resulting powder takes on a closest-packed structure. The perchlorate is suitably added to the composition in the range of 45 to 87% by weight. The reason for this is to prevent the composition from forming any substantial amounts of carbon monoxide and to allow the cellulose acetate to be incorporated into the composition by at least 8% by weight.

The bitetrazole metal hydrate is a hydride of a substance to be obtained by substituting the hydrogen atoms of bitetrazole ($C_2N_8H_2$) with a metal. This hydride is typified by such compounds as bitetrazole manganese dihydrate ($C_2N_8Mn.2H_2O$), bitetrazole calcium dihydrate ($C_2N_8Ca.2H_2O$), etc. Bitetrazole metal hydrates have excellent heat stability and produce large amounts of nitrogen, carbon dioxide, water and oxygen when burned with potassium perchlorate. Bitetrazole manganese dihydrate is the most preferred among other bitetrazole metal hydrates, because it forms no corrosive residue after burning. This bitetrazole metal hydrate need not be limited to dihydride, and may well be monohydride, trihydride, etc. However, bitetrazole metal anhydride is unsuitable, because it shows no effect of inhibiting the rise in the compound's combustion temperature.

Since the bitetrazole metal hydrate has a low heat of formation, the combustion temperature of the composition can be held low by incorporating the hydride together with the cellulose acetate and potassium perchlorate. Specifically, the combustion temperature of the composition is decided depending on the calorific value of the heat generated by the reaction between cellulose acetate, hydride and potassium perchlorate. The calorific value is calculated by subtracting, the heat of formation in the formation system from the heat of formation of the hydride, etc. in the original system. Accordingly, the smaller the heat of formation of the hydride is, the smaller the calorific value becomes. This prevents a rise from occurring in the combustion temperature.

If the amount of the hydride to be incorporated exceeds 36% by weight, the amount of cellulose acetate to be incorporated will be less than 8% by weight so as to prevent substantially formation of carbon monoxide. In such cases, the powder particles may not be fully covered with cellulose acetate. Accordingly, the hydride is suitably incorporated in an amount of 36% by weight or less. Any amount of hydride exceeding 36% by weight would, therefore, be inappropriate. The preferred particle size of the hydride, in order to maximize the composition's combustibility, should be 30 μm or less.

The metal oxide has excellent heat stability and releases oxygen when burned which serves as an oxidizing agent. The metal oxide includes, for example, copper oxide, manganese dioxide, iron oxide and nickel oxide. The metal oxide is reduced, during combustion, to a simple noncorrosive metal. Moreover, the reaction that occurs when the metal oxide releases oxygen is endothermic effectively allowing for further control of the gas generator combustion temperature. A further endothermic reaction occurs with the melting of the metal. This allows even more control over the gas generator combustion temperature.

Like that of the hydride, the preferred particle size of the metal oxide, in order to maximize the composition's combustibility, should be 30 μm or less.

Next, a nitrogen-containing nonmetallic compound is employed to control the combustion temperature. The compound consists of nitrogen and hydrogen at a minimum and contains at least 11% by weight of nitrogen. This compound includes other compounds containing oxygen or carbon and consists of at least one selected from the group of guanidine compounds, oximes, amides, tetrazole derivatives, aromatic nitro compounds and ammonium nitrate.

Examples of these compounds include: for the guanidine compound, nitroguanidine ($CH_4N_4O_2$, nitrogen content: 53.8%), triaminoguanidine nitrate ($CH_9N_7O_3$, nitrogen content: 58.6%) and guanidine nitrate ($CH_6N_4O_3$, nitrogen content: 45.9%); for the oxime, hydroxyglyoxime ($C_2H_4O_4N_2$, nitrogen content: 23.3%); for the amide, oxamide ($C_2H_4N_2O_2$, nitrogen content: 31.8%); for the tetrazole derivative, aminotetrazole ($N_5H_3C$, nitrogen content: 82.4%); for the aromatic nitro compound, nitrotoluene ($NH_7O_2C_7$, nitrogen content: 11.6%); and for the ammonium nitrate ($NH_4NO_3$, nitrogen content: 23.3%). These compounds assume solid or liquid phase at room temperature (15°~25° C.).

If the nitrogen content of the compound is low, a large amount of oxidizing agent becomes necessary to prevent any substantial amount of carbon monoxide from forming in any gas generated, so that the compound cannot be incorporated in an increased amount. Accordingly, the compound is required to have a nitrogen content of at least 11% by weight. While it is preferred that the nitrogen content be relatively high, the upper limit is preferably 83% by weight. This allows the compound to be easily handled and produced on an industrial scale. Thus, the compound, when burned after it is admixed with a perchlorate, generates large amounts of nitrogen, carbon dioxide, water and oxygen. In addition, since the compound contains no metallic elements, it enjoys an advantage in that it forms no residue after burning.

The amount of the gas to be generated from the gas generator increases as the amount of the nitrogen-containing nonmetallic compound increases. Specifically, this compound increases the percentage of nitrogen gas in the generated gas, and thus provides a cleaner gas. However, care must be taken so that the amount of the compound added does not cause any significant amount of carbon monoxide to form in the generated gas. Moreover, care must be taken so that the amount of cellulose acetate to be incorporated is at least 8% by weight so that the powder particles may fully be covered with the cellulose acetate.

Therefore, the amount of the compound to be incorporated preferably is within the range of 10 to 45% by weight.

In the composition of the present invention, cellulose acetate may partly be replaced with a plasticizer having good compatibility to the cellulose acetate. Such plasticizer can be triacetin ($C_3H_5(OCOCH_3)_3$), diethyl phthalate or dimethyl phthalate of these plasticizers, triacetin and dimethyl phthalate are preferred, because triacetin generates a large amount of oxygen and does not require a large amount of oxidizing agent, while dimethyl phthalate has excellent heat stability and excellent compatibility with cellulose acetate.

Further, a combustion controller such as a metal powder and carbon black can, as necessary, be incorporated in the present composition.

Next, the thus obtained composition of the present invention can be molded into a desired shape such as pellet, rod, disc, etc.

Since the thus constituted composition of the present invention contains no sodium azide, it can be handled easily and will not form corrosive sodium or sodium compounds. Further, the present composition prevents any substantial amounts of carbon monoxide from forming in the generated gas, and therefore is highly reliable. In addition, the present composition generates large amounts of gas, so that the air bag can reliably and fully inflated. Besides, since the present composition has a low combustion temperature, the amount of the cooling agent in the container for gas generator can be reduced. Consequently, the size of the container for the gas generator can be reduced.

The present invention will now be described more specifically by way of Examples and Comparative Examples.

EXAMPLE 1

One embodiment of the invention will be described referring to FIG. 1.

A gas generator composition was first prepared in the following manner. A primary composition was prepared as a raw material mixture. The primary composition contained 11% by weight of cellulose acetate having an acetylation degree of about 53% (Teijin, Limited) as a deoxidized agent which is to be oxidized to produce a gas; 4% by weight of dimethyl phthalate (reagent chemical, Wako Pure Chemical Ind., Ltd.) as the plasticizer, 55% by weight of potassium perchlorate having an average particle size of 17 μm (Nippon Carlit Kabushiki-Kaisha) as an oxidizing agent; and 25% by weight of copper oxide having an average particle size of 8 μm (Mitsui Mining & Smelting Co., Ltd.) as the combustion temperature controller. An appropriate amount of mixed solvent of acetone and methyl alcohol was added to the primary composition, and the resulting mixture was blended to provide a homogeneous chemical knead.

Subsequently, the chemical knead was charged to an extruder provided with a die having a diameter of 4 mm, and the knead was pressed into the die and extruded into a form of a rod. This product was cut into a length of 2 mm and dried to obtain a pelletized gas generator composition as a secondary composition.

As shown in FIG. 1, the container for gas generator 1 has an igniter chamber 2 at the center thereof, and a combustion chamber 3 defined coaxially around the igniter chamber 2. A cooling chamber 4 is also defined coaxially around the combustion chamber 3. A squib 5 and an igniter 6 are disposed in the igniter chamber 2, and the igniter 6 is ignited when the squib 5 is fired upon energization.

The pelletized gas generator 7 was loaded in the combustion chamber 3 and burned by the flame of the igniter 6 to generate a gas containing $CO_2$ and $N_2$. In this embodiment, the amount of the gas generator 7 is preset so that about 30 lit. of gas is generated under normal temperature and pressure conditions. Cooling filters 8,9 are disposed in the combustion chamber 3 and the cooling chamber 4, respectively. The cooling filters 8,9 serve to cool the gas as well as to filter off and collect the solid combustion residues.

A wall interposed between chambers 2,3 contains a plurality of openings 10 through which the flame produced from the igniter 6 is communicated into the chamber 3. Gas generated in chamber 3 is provided to cooling chamber 4 via openings 11 in wall 13. A wall 15 of cooling chamber 4 incorporates a port 14 through which gas cooled in the chamber 4 is provided to an air bag 16.

In case of a car crash, the igniter 6 is ignited by the squib 5 based on a signal output from a sensor (not shown). The flame from the igniter 6 propagates through the openings 10 into the chamber 3. The gas generator 7 in the chamber 3 is burned to generate a gas. The generated gas passes through the cooling filter 8 and openings 11 and is exhausted from the port 14 to the air bag 16.

Optimum loading weights of the various compounds used for the gas generator were determined as shown in FIG. 1. The container for gas generator 1 was attached to the inside of a 60 lit. tank the internal temperature of which was measured using an alumel-chromel thermocouple having a wire diameter of 50 μm.

Meanwhile, a cylindrical product (hereinafter referred to as a strand) having a diameter of 4 mm and a length of 80 mm was prepared separately as the gas generator 7 and used for measuring burning rate. The burning rate was determined in the following manner. First the cylindrical surface of the strand was coated with an epoxy resin so as to prevent overall firing of the strand. Two small holes were formed diametrically across the strand at appropriate intervals using a 0.5 mm-diameter drill, and a fuse for measuring the combustion time was inserted to each hole. The strand, prepared as described was then cramped on a predetermined mount.

Next, the strand was ignited at one end thereof using a nichrome wire under a pressure of 30 atm. During the course of time the flame took to pass along the surface of the strand, the instant at which each fuse became disconnected was electronically measured. The distance between the two holes was then divided by the difference in the fusing time to obtain a burning rate in terms of linear burning rate. The result is as shown in the following Table 1.

EXAMPLES 2 TO 5

Gas generator compositions were prepared in the same manner as in Example 1 using the compositions as shown in Table 1, respectively, and the properties of these compositions were evaluated in the same manner as in Example 1. The results are as shown in Table 1.

Comparative Examples 1 to 3

Gas generator compositions were prepared in the same manner as in Example 1 using the compositions as shown in Table 1, respectively, and the properties of these compositions were evaluated likewise. The results are also shown in Table 1.

It should be noted that the in-tank gas temperature changed as the gas generator composition burned and that the higher the combustion temperatures corresponded to higher generated gas temperatures.

TABLE 1

| Example or Comp. Example | Loading (wt %) Cellulose acetate | Dimethyl phthalate | Potassium perchlorate | Copper oxide | Iron oxide | In-tank gas temperature (°C.) | Burnimg rate mm/sec |
|---|---|---|---|---|---|---|---|
| Ex. 1 | 11 | 4 | 55 | 25 | — | 301 | 12 |
| Ex. 2 | 12 | 7 | 63 | — | 18 | 320 | 11 |
| Ex. 3 | 8 | 1 | 51 | 40 | — | 297 | 10 |
| Ex. 4 | 12 | 5 | 76 | 7 | — | 323 | 12 |
| Ex. 5 | 10 | — | 75 | 15 | — | 317 | 11 |
| Comp. Ex. 1 | 15 | 6 | 79 | — | — | 407 | 11 |
| Comp. Ex. 2 | 8 | 1 | 50 | 41 | — | 275 | 4 |
| Comp. Ex. 3 | 14 | 4 | 77 | 5 | — | 402 | 11 |

The data of Table 1 suggest the following aspects. In a comparison between Example 1 and Comparative Example 1, the addition of copper oxide to the composition lowered the in-tank gas temperature under when the burning rate remained virtually constant. Also, in a comparison between Example 2 and Comparative Example 1, the addition of iron oxide to the composition lowered the in-tank gas temperature.

Where, as shown in a comparison between Example 3 and Comparative Example 2, the addition of copper oxide was more than 40% by weight, the in-tank gas temperature decreased, but the burning rate was abruptly lowered. Accordingly, the amount of incorporated metal oxide, depending on the kind of metal oxides, should be 40% by weight or less.

The comparison between Example 4 and Comparative Example 3 demonstrates that the in-tank gas temperature reaches as high as 402° C. when the metal oxide is added in an amount of 5% by weight or less, and that the inside of the tank is not fully cooled. Accordingly, the amount of the metal oxide to be incorporated, which also depends on the kind of metal oxides, should be more than 5% by weight.

In addition, in the case where no dimethyl phthalate is incorporated like in Example 5, the internal temperature of the tank can be lowered. Significantly, the compositions in the respective Examples did not produce any substantial amount harmful carbon monoxide.

EXAMPLE 6

A composition was prepared as a raw material mixture containing 11% by weight of cellulose acetate having an acetylation degree of about 53% (Teijin, Limited), 4% by weight of triacetin (Daihachi Kagaku Kogyosho), 55% by weight of potassium perchlorate having an average particle size of 17 μm (Nippon Carlit Kabushiki-Kaisha) and 30% by weight of bitetrazole manganese dihydrate having an average particle size of 22 μm (Toyo Kasei Kogyo Kabushi-Kaisha). A solvent containing a mixture of acetone and methyl alcohol was added to the compound, and the resulting mixture was blended to produce a homogeneous chemical knead.

Subsequently, the chemical knead was molded in the same manner as in Example 1 to provide a pelletized composition.

The composition of the gas generated during burning of the gas generator composition at 800° C. and the amount of the thus generated gas at normal temperature and under normal pressure were determined using a pyrolytic gas chromatograph (Model GC-14A) manufactured by Shimadzu Corporation.

Separately, the gas generator composition was loaded, in the container for gas generator shown in FIG. 1, in such an amount that ca. 30 lit. of gas as measured at normal pressure and under normal pressure could be generated.

Subsequently, the container for gas generator 1 was attached to a 60 lit. tank and operated. The internal temperature of the tank was measured using an alumel-chromel thermocouple having a wire diameter of 50 μm. The result is as shown in Table 2. It should be noted that the amount of gas generated is indicated in Table 2 in terms of total volume of carbon dioxide, water, oxygen and nitrogen, generated when 1 g of the gas generator composition was burned, as measured under normal temperature and pressure conditions.

EXAMPLES 7 TO 10

Gas generator compositions were prepared in the same manner as in Example 6 using the compositions as shown in Table 2, respectively, and the properties of these compositions were evaluated in the same manner as in Example 6. The results are as shown in Table 2.

Comparative Examples 4 and 5

Gas generator compositions were prepared in the same manner as in Example 6 using the compositions as shown in Table 2, respectively, and the properties of these compositions were evaluated in the same manner as in Example 6. The results are as shown in Table 2.

Comparative Example 6

A gas generator composition was prepared in the same manner as in Example 6, except that bitetrazole manganese dihydrate was replaced by bitetrazole manganese anhydride obtained by calcination of bitetrazole manganese dihydrate at 200° C., and the properties of the composition was evaluated in the same manner as in Example 6. The results are as shown in Table 2.

TABLE 2

| Example or Comp. Example | Loading (wt %) Cellulose acetate | Triacetin | Potassium perchlorate | Dihydride bitetrazole Mn | Amount of gas generated liter/g | CO level in gas formed ppm | In-tank gas temperature (°C.) |
|---|---|---|---|---|---|---|---|
| Ex. 6 | 11 | 4 | 55 | 30 | 0.465 | 2800 | 240 |
| Ex. 7 | 12 | 5 | 63 | 20 | 0.437 | 1200 | 274 |
| Ex. 8 | 17 | 6 | 72 | 5 | 0.409 | 700 | 345 |
| Ex. 9 | 8 | 1 | 55 | 36 | 0.480 | 3300 | 215 |
| Ex. 10 | 18 | 0 | 63 | 19 | 0.430 | 1350 | 280 |
| Comp. Ex. 4 | 15 | 6 | 79 | 0 | 0.385 | 600 | 407 |
| Comp. Ex. 5 | 8 | 2 | 50 | 40 | 0.439 | 46000 | 201 |
| Comp. Ex. 6 | 11 | 4 | 55 | 30 | 0.451 | 4900 | 386 |

As shown in Table 2, in Examples 6 to 10, bitetrazole manganese dihydrate is incorporated in the compound by an amount of 36% by weight or less. Accordingly, a predetermined amount of gas can readily and predictably generated in any of Examples 6 to 10. Harmful CO in the gas generated can likewise be held at a low level. Besides, the in-tank gas temperature can be maintained at a low level. Further, in the case where no triacetin is incorporated (Example 10), the properties were all well balanced and maintained at optimum levels.

In the case where no bitetrazole metal hydrate was incorporated (Comparative Example 4), not only did the in-tank gas temperature increase, but the volume of gas generated was significantly small. Further, in the case where the bitetrazole metal hydrate was incorporated in an amount of more than 36% by weight (Comparative Example 5), the CO level in the gas generated was at relatively high levels. In the case where bitetrazole metal anhydride was used (Comparative Example 6), not only was the CO level in the generated gas high, but the in-tank gas temperature increased as well.

EXAMPLE 11

For this example, a composition was prepared as a raw material mixture, as shown in Table 3, containing 8% by weight of cellulose acetate having an acetylation degree of 53% (Teijin, Limited), 2% by weight of triacetin (Daihachi Kagaku Kogyosho), 55% by weight of potassium perchlorate having an average particle size of 17 μm (Nippon Carlit Kabushiki-Kaisha) and having 35% by weight of nitroguanidine (Chugoku Kayaku Kabushiki-Kaisha) as a nitrogen-containing nonmetallic compound. A solvent containing a mixture of acetone and methyl alcohol was added to the composition, and the resulting mixture was blended to provide a homogeneous chemical knead.

Subsequently, the chemical knead was molded in the same manner as in Example 1 to provide a pelletized composition.

The composition of the gas generated during burning of the gas generator composition at 800° C. and the amount of the generated gas at normal temperature and under normal pressure were determined using the same gas chromatograph (Model GC-14A) as used in Example 6.

Next, the gas generator composition was loaded in the gas generator container in the same manner as in Example 1. The container for gas generator 1 was attached to a 60 lit. tank and operated with the internal temperature of the tank being measured using an alumel-chromel thermocouple having a wire diameter of 50 μm. The results are as shown in Table 4. It should be noted that the amount of the gas generated in Table 4 is indicated in terms of total volume of carbon dioxide, water, oxygen and nitrogen, generated when 1 g of the gas generator composition was burned, as measured under normal conditions.

EXAMPLES 12 TO 19

Gas generator compositions were prepared in the same manner as in Example 11 using the compositions as shown in Table 3, respectively, and the properties of these compositions were evaluated likewise. The results are as shown in Table 4.

Comparative Examples 7 and 8

Gas generator compositions were prepared in the same manner as in Example 11 using the compositions as shown in Table 3, respectively, and the properties of these compositions were evaluated likewise. The results are as shown in Table 4.

It should be noted that the in-tank gas temperature changed as the gas generator composition burned and that the higher the combustion temperatures corresponded to higher generated gas temperatures.

TABLE 3

| Example or Comp. Example | Loading (wt %) Cellulose acetate | Triacetin | Potassium perchlorate | N-containing nonmetallic compound | |
|---|---|---|---|---|---|
| Ex. 11 | 8 | 2 | 55 | Nitroguanidine | 35 |
| Ex. 12 | 8 | 4 | 57 | Triaminoguanidine nitrate | 31 |
| Ex. 13 | 8 | 3 | 56 | Guanidine nitrate | 33 |
| Ex. 14 | 10 | 5 | 65 | Aminotetrazole | 20 |
| Ex. 15 | 8 | 3 | 62 | Oxamide | 27 |
| Ex. 16 | 8 | 3 | 56 | Dihydroxyglyoxime | 33 |
| Ex. 17 | 8 | 4 | 78 | Nitrotoluene | 10 |
| Ex. 18 | 10 | 5 | 45 | Ammonium nitrate | 40 |
| Ex. 19 | 11 | 0 | 47 | Ammonium nitrate | 42 |
| Comp. Ex. 7 | 14 | 7 | 79 | — | 0 |
| Comp. Ex. 8 | 8 | 4 | 82 | N,N-Diethylaniline | 6 |

TABLE 4

| Example or Comp. Ex. | N-containing nonmetallic compound used: Name | Nitrogen content wt % | Amount of gas generated liter/g | CO level in gas formed ppm | In-tank gas temperature (°C.) |
|---|---|---|---|---|---|
| Ex. 11 | Nitroguanidine | 53.8 | 0.513 | 2500 | 395 |
| Ex. 12 | Triaminoguanidine nitrate | 58.6 | 0.521 | 1800 | 402 |
| Ex. 13 | Guanidine nitrate | 45.9 | 0.501 | 1050 | 376 |
| Ex. 14 | Aminotetrazole | 82.4 | 0.507 | 1450 | 392 |
| Ex. 15 | Oxamide | 31.8 | 0.513 | 2300 | 353 |
| Ex. 16 | Dihydroxyglyoxime | 23.3 | 0.465 | 1450 | 363 |
| Ex. 17 | Nitrotoluene | 11.6 | 0.406 | 3700 | 405 |
| Ex. 18 | Ammonium nitrate | 35.0 | 0.613 | 500 | 338 |
| Ex. 19 | Ammonium nitrate | 35.0 | 0.622 | 400 | 331 |
| Comp. Ex. 7 | — | — | 0.387 | 1200 | 407 |
| Comp. Ex. 8 | N,N-Diethylaniline | 9.4 | 0.389 | 3200 | 404 |

As shown in Table 3, 8 to 11% by weight of cellulose acetate, 45 to 78% by weight of potassium perchlorate and 10 to 42% by weight of nitrogen-containing nonmetallic compound were incorporated respectively in the compositions of Examples 11 to 19. Table 4 illustrates that the content of harmful carbon monoxide in the gas generated during combustion of the gas generator was 3700 ppm at most, which prevents any substantial amounts of carbon monoxide from forming.

In comparison with Comparative Example 7 containing no nitrogen-containing nonmetallic compound, the compositions of Examples 11 to 19 in Table 4 show an increase in the amount of the gas generated as well as a decrease in the in-tank gas temperature. Where the nitrogen content in the nitrogen-containing nonmetallic compound is 9.4%, like that in Comparative Example 8, there was neither an increase in the amount of the gas generated nor a drop in the in-tank gas temperature. Further, in the case where no triacetin was incorporated as a plasticizer (Example 19), the properties were all well balanced and maintained at optimum levels.

Although several embodiments of the present invention have been described herein, it should be apparent to those skilled in the art that the present invention may be embodied in many other specific forms without departing from the spirit or scope of the invention. Particularly, it should be understood that the following modes are to be applied.

(1) The degree of acetylation for cellulose acetate employed in respective Examples may be changed;

(2) The gas generator 7 of the present invention may be loaded in the gas generator container employed in the air bag apparatus for front passenger seat in addition to that for driver's seat; and (3) The gas generator 7 may be loaded in the container for gas generator of an air bag apparatus such as life jacket, inflatable raft and escape chute.

Therefore, the present examples and embodiments are to be considered as illustrative and not restrictive, and the invention is not to be limited to the details given herein, but may be modified within the scope of the appended claims.

What is claimed is:

1. A gas generator composition, comprising:

a cellulose acetate acting as a deoxidized agent that generates a predetermined composition of gas upon being oxidized;

a perchlorate acting as an oxidizing agent, the mixture of said cellulose acetate and said perchlorate being the major ingredient of said gas generator composition; and a metal oxide acting as a combustion temperature controller, said metal oxide being more than 5% by weight and not more than 40% by weight of said gas generator composition.

2. The gas generator composition according to claim 1, wherein the content of said cellulose acetate is 8 to 26% by weight.

3. The gas generator composition according to claim 1, wherein the content of said perchlorate is 45 to 87% by weight.

4. The gas generator composition according to claim 1, wherein said perchlorate is potassium perchlorate.

5. The gas generator composition according to claim 4, wherein said potassium perchlorate has a particle size of 5 to 300 μm.

6. The gas generator composition according to claim 1, wherein said metal oxide is formed from at least one compound selected from the group consisting of copper oxide, manganese dioxide, iron oxide and nickel oxide.

7. The gas generator composition according to claim 1, wherein said metal oxide has a particle size of 30 μm or less.

8. The gas generator composition according to claim 1, wherein said cellulose acetate contains a plasticizer.

9. The gas generator composition according to claim 8, wherein said plasticizer is triacetin or dimethyl phthalate.

10. A gas generator composition, comprising:

a cellulose acetate acting as a deoxidized agent that generates a predetermined composition of gas upon being oxidized;

potassium perchlorate acting as an oxidizing agent, the mixture of said cellulose acetate and said perchlorate being the major ingredient of said gas generator composition; and a bitetrazole metal hydrate acting as a combustion temperature controller that forms 36% by weight or less of said gas generator composition.

11. The gas generator composition according to claim 10, wherein said bitetrazole metal hydrate has a particle size of 30 μm or less.

12. The gas generator composition according to claim 10, wherein said bitetrazole metal hydrate is bitetrazole manganese dihydrate.

13. The gas generator composition according to claim 10, wherein said cellulose acetate contains a plasticizer.

14. The gas generator composition according to claim 13, wherein said plasticizer is triacetin or dimethyl phthalate.

15. A gas generator composition, comprising:

a cellulose acetate acting as a deoxidized agent that generates a predetermined composition of gas upon being oxidized;

a perchlorate acting as an oxidizing agent, the mixture of said cellulose acetate and said perchlorate being the major ingredient of said gas generator composition; and a nonmetallic compound acting as a combustion temperature controller, said nonmetallic compound comprising nitrogen and hydrogen, wherein the amount of said nitrogen is at least 11% by weight of said nonmetallic compound.

16. The gas generator composition according to claim 15, wherein said nonmetallic compound is formed from at least one compound selected from the group consisting of guanidine compounds, oximes, amides, tetrazole derivatives, aromatic nitro compounds and ammonium nitrate.

17. The gas generator composition according to claim 15, wherein said nonmetallic compound has a nitrogen content of 11 to 83% by weight.

18. The gas generator composition according to claim 15, wherein the content of said nonmetallic compound is 10 to 45% by weight.

19. The gas generator composition according to claim 15, wherein said cellulose acetate contains a plasticizer.

20. The gas generator composition according to claim 19, wherein said plasticizer is triacetin or dimethyl phthalate.

* * * * *